US006393648B1

(12) United States Patent
Reynolds

(10) Patent No.: US 6,393,648 B1
(45) Date of Patent: May 28, 2002

(54) RESILIENT ATTACHABLE TOOL CLEANING APPARATUS

(75) Inventor: Mark D. Reynolds, Austin, TX (US)

(73) Assignee: Reyntech Partnership, Austin, TX (US)

( * ) Notice: Subject to any disclaimer, the term of this patent is extended or adjusted under 35 U.S.C. 154(b) by 0 days.

(21) Appl. No.: 09/478,767

(22) Filed: Jan. 6, 2000

(51) Int. Cl.[7] ..... A46B 15/00
(52) U.S. Cl. ..... 15/160; 15/210.1; 15/227
(58) Field of Search ..... 15/104.92, 160, 15/210.1, 227, 218, 218.1, 220.4

(56) References Cited

U.S. PATENT DOCUMENTS

| | | | | | |
|---|---|---|---|---|---|
| 706,997 | A | * | 8/1902 | Ogborn | 15/218 |
| 1,761,375 | A | * | 6/1930 | Vaught | 15/218 |
| 1,783,788 | A | * | 12/1930 | Hatchett, Sr. | 15/160 |
| 3,460,182 | A | * | 8/1969 | Grande, Jr. | 15/227 |
| 3,699,672 | A | * | 10/1972 | Sims | 15/227 X |
| 3,735,442 | A | * | 5/1973 | Lukas | 15/227 |
| 4,122,577 | A | | 10/1978 | Catania | 15/160 |
| 4,407,079 | A | | 10/1983 | Chiroff | 36/127 |
| 4,464,072 | A | | 8/1984 | Norwell | 401/137 |
| 4,823,426 | A | * | 4/1989 | Bragga | 15/210.1 |
| 5,173,985 | A | * | 12/1992 | Palmer | 15/227 |
| 5,555,589 | A | | 9/1996 | Moultrie | 15/105 |
| 5,765,233 | A | | 6/1998 | Hayes | 2/227 |
| 5,797,142 | A | | 8/1998 | Debronsky et al. | 2/69 |
| 5,809,669 | A | | 9/1998 | Hage et al. | 36/127 |
| 5,893,190 | A | | 4/1999 | Mertz | 15/209.1 |
| 5,898,968 | A | | 5/1999 | Beattie | 15/210.1 |
| 5,943,792 | A | * | 8/1999 | Powell | 15/227 X |
| 6,003,190 | A | * | 12/1999 | Knudsen | 15/210.1 |

FOREIGN PATENT DOCUMENTS

| | | | | |
|---|---|---|---|---|
| CH | 256246 | * | 2/1949 | 15/227 |

* cited by examiner

*Primary Examiner*—Mark Spisich
(74) *Attorney, Agent, or Firm*—J. Nevin Shaffer, Jr.; Shaffer & Culbertson, L.L.P.

(57) ABSTRACT

A resiliently attachable tool cleaner (10) having a support base (12) with a cleaning surface (14) attached thereto. A resilient, expandable and contractable, attachment (16) is connected to the support base (12) for securing the support base (12) in a desired location. In a preferred embodiment, the support base (12) includes a connection side (30) and a cleaning attachment side. The connection side (30) is connected to the resilient, expandable and contractable, attachment (16) and the cleaning attachment side has an angled attachment face (36) such that the cleaning surface (14) presents and outwardly facing downward angle aspect.

10 Claims, 1 Drawing Sheet

RESILIENT ATTACHABLE TOOL CLEANING APPARATUS

BACKGROUND OF THE INVENTION

This invention relates to a resilient, attachable tool cleaning mechanism.

Both manual and mechanical cleaning devices have been around for some time. A common problem when using a tool is the requirement to clean a tool periodically during use. A wide variety of construction tools, such as putty knives, spackling blades, and the like require periodic cleansing during use. Likewise, golfers, when practicing with golf clubs often hit many consecutive shots with a single club. Depending on the type of shot, it is not unusual for the golf club to collect dirt, grass, sand and the like after each swing. Serious golfers ensure that the golf club face is clean each time it is used so as to ensure that the golf club face imparts the correct spin, loft, and so forth to the golf ball when the ball is struck. As a result, historically, golfers carry golf towels for just this purpose, i.e. cleaning the club face in between uses.

The prior art discloses a variety of additional methods designed to address this particular problem. The Catania Pat., U.S. Pat. No. 4,122,577, discloses a rigid plate that is designed to be attached to the bottom of a golf shoe by screws. Once attached, the plate extends upwardly and away from the bottom of the golf shoe and is designed to hold a wiping element so as to enable a golfer to clean the club by a sweeping movement of the head against the device. Moultrie, U.S. Pat. No. 5,555,589, discloses a golf club and a golf shoe cleaning brush that is attached to a golf bag at one end and to the brush at the other by a retractable, elastic cord. Hayes, U.S. Pat. No. 5,765,233, discloses a disposable golf club wiping patch designed to be attached to a golfer's pants. The patch has a scouring material on one side and a removably attachable adhesive on the other. The adhesive side of the device is then directly attached to the pants so that the scouring material may be used by the golfer to clean the golf club face. Hage, U.S. Pat. No. 5,809,669, discloses a similar device which utilizes adhesive which is designed to be attached directly to a golf shoe. Norwell, U.S. Pat. No. 4,464,072, discloses a device for cleaning golf clubs in the form of a liquid dispenser with a brush attached to it that is attached to the golfer's bag. The Debronsky, Jr., et al. Patent, U.S. Pat. No. 5,797,142, is directed to a more traditional, removably attachable golf club cleaning towel. Likewise, Beattie, U.S. Pat. No. 5,898,968, discloses a golf club towel sock designed to encompass the head of a golf club, as well as containing a pouch for cleaning, holding and dispensing a golf ball.

As A drawback to the tool/club cleaning devices known in the art is that they are time consuming and difficult to attach and, once attached, are not readily removable, and further, risk damaging the user's clothing, pants, shoes and the like upon removal. A further drawback is that the devices require mechanical connections and are limited to a reasonable range of sizes and therefore, are not suitable or adapted for use with all sizes on the large and small end of a size scale. Thus, there is a need in the art for providing a resiliently attachable tool cleaning device that is easy to put on and take off, which does not damage the user, or the user's clothing, during use or removal and which is useful with any size of object to which the cleaner is to be attached. It, therefore, is an object of this invention to provide a resiliently attachable tool cleaning apparatus and method for simply and easily enabling the cleaning of a tool intermittently during tool use.

SHORT STATEMENT OF THE INVENTION

Accordingly, the resiliently attachable tool cleaning device of the present invention includes a support base. A cleaning surface is attached to the support base for cleaning a tool, club, or the like. Further, a resilient, expandable and contractable, attachment is connected to the support base for securing the support base in a desired location. In a preferred embodiment, the cleaning surface is a washable, bristle brush that is attached to the support base. The cleaning surface, bristle brush, may be removably attachable to Fe support base for cleaning, replacement and the like. Further, the support base is designed so that the cleaning surface, when attached, projects outwardly and faces downwardly so as to provide an outward facing downward angled cleaning surface for use with cleaning a tool, golf club, and the like. Further, in a preferred embodiment, the resilient, expandable and contractable, attachment is an expandable, contractable, elastic compression strap. In use, the expandable, contractable, elastic compression strap can be expanded to slip over a golfer's shoe and then be released so as to be held in place. In another preferred embodiment, the elastic compression strap includes a first elastic compression strap section removably attachable to a second elastic compression strap section so that the tool cleaning apparatus can be attached and removed without having to be passed over the entire object to which it is to be attached.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
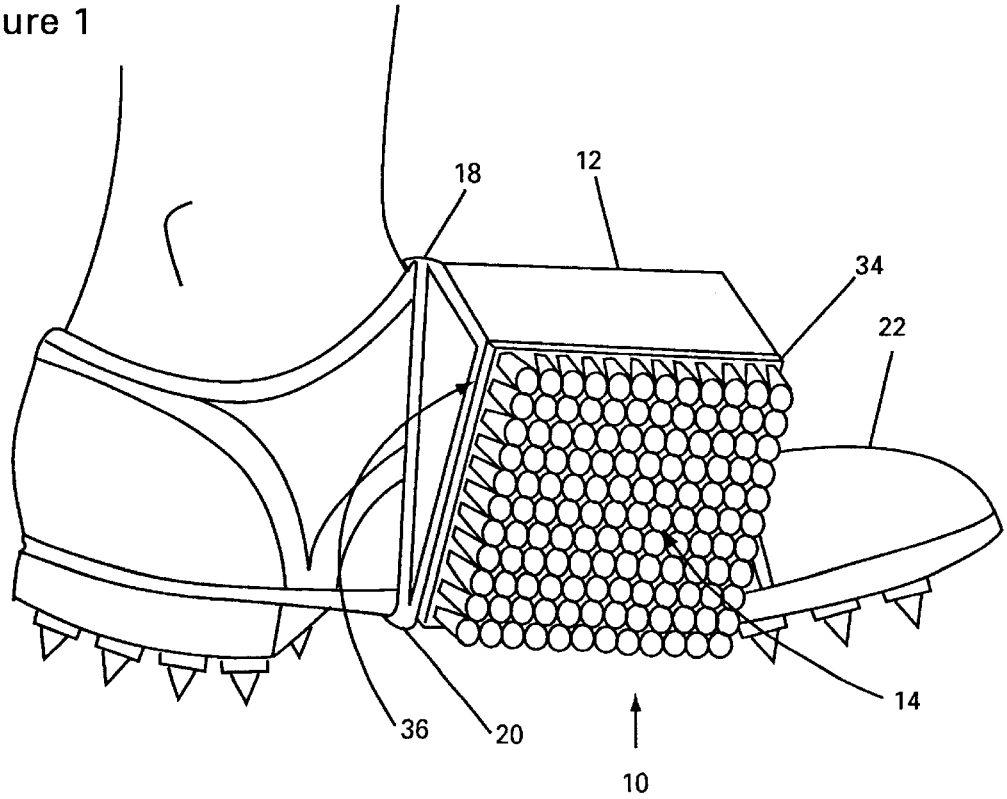
FIG. 1 is a perspective view of a preferred embodiment of the resilient, attachable tool cleaning apparatus of the present invention shown attached to a golfer's shoe.
Figure 2:
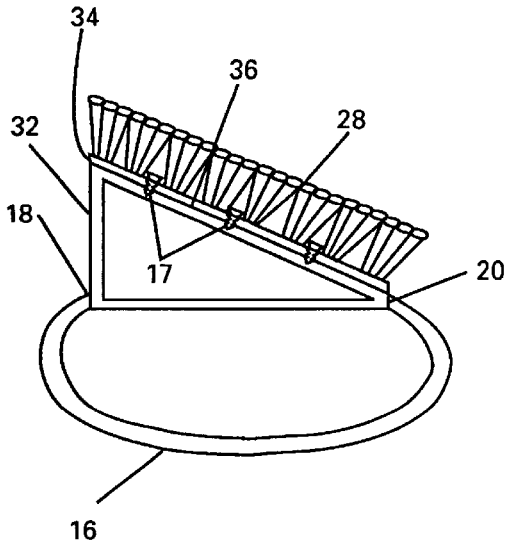
FIG. 2 is a side view of the invention in FIG. 1 showing a unitary, resilient, expandable and contractable, attachment device.
Figure 3:
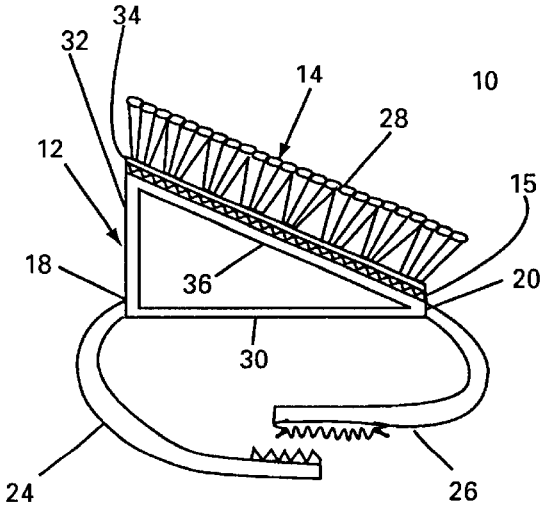
FIG. 3 is a side view illustrating a preferred embodiment of the invention with a first elastic compression strap section and a second elastic compression strap section.

The preferred embodiment of the present invention is illustrated by way of example in FIGS. 1–3. With specific reference to FIGS. 1 and 2, a resiliently attachable tool clear 10 includes a support base 12, a cleaning surface 14 attached to the support base 12 and a resilient, expandable and contractable, attachment 16 also connected to support base 12. As more clearly seen in FIG. 2, resilient, expandable and contractable, attachment 16 s connected to support base 12 at support base 12 tipper edge 18 and lower edge 20. A continuous loop of resilient, expandable and contractable, attachment 16 is then formed. With reference to FIG. 1, resilient, expandable and contractable, attachment 16 is stretched so as to pass around the object to which it is to be attached, in this case golf shoe 22. Once in place, resilient, expandable and contractable, attachment 16 is released, and because it is resilient, it contracts and holds support base 12, and thereby cleaning surface 14, in place where positioned.

For the purposes of this application, the term resilient means elastic, such that the attachment material, when stretched or expanded, returns or contracts to the resting shape when released. Further, when the attachment is expanded and released and yet there is an intervening object which prevents it from returning to its original shape, the material is resilient in the sense that it continues to apply compressive force to the object as it attempts to return to its original smaller form. Any such "resilient" material now known, or hereafter developed, is suitable, such as rubber bands, woven rubber and fabric such as found in stretchable ACE brand elastic bandages, and so forth.

Referring now to FIG. 3, another preferred embodiment of the invention is disclosed wherein resilient, expandable and contractable, attachment 16 is formed by the combination of a first elastic compression strap 24 and a second elastic compression strap 26. In situations where it is impossible to pass resilient, expandable and contractable, attachment 16 in its closed loop form (as illustrated in FIG. 2), over the object to which resiliently attachable tool cleaner 10 is desired to be attached, the embodiment in FIG. 3 is useful. In this embodiment, first elastic compression strap 24 is removably attachable to second elastic compression strap 26. FIG. 3 illustrates the use of hook and loop material to accomplish the removably attachable connection between first elastic compression strap 24 and second elastic compression strap 26. Certainly, any other form of temporary attachment known in the art or hereafter developed may be used such as snaps, ties, buckles, and so forth.

FIGS. 1, 2, and 3 further illustrate a preferred embodiment of the invention wherein cleaning surface 14 is removably attachable to support base 12. Cleaning surface 14 may be attached to support base 12 by means of hook and loop material 15 as illustrated in FIG. 3 or by removable screws 17 as shown in FIG. 2. Any other means now known or hereafter developed are appropriate as well. Additionally, in a preferred embodiment, cleaning surface 14 is a washable, bristle brush 28. Obviously, cleaning surface 14 is not limited to a washable bristle brush, but may be any form of cleaning surface, cloth, plastic, metal or the like that serves to clean the tool being used.

FIGS. 1, 2, and 3 also illustrate a preferred embodiment of the invention wherein support base 12 is comprised of connection side 30 to which resilient, expandable and contractable, attachment 16 is connected. Connection side 30 has, again, upper edge 18 and lower edge 20. Connected to upper edge 18 is top 32. Top 32 is connected all along upper edge 18 as shown in FIG. 1, and extends outwardly from upper edge 18 some distance to outward extended top edge 34. Attachment face 36 is connected along outward extended top edge 34 and lower edge 20. As a result, as shown in FIGS. 2 and 3, connection side 30 and top 32 form an upside down right triangle to which attachment face 36 becomes a hypotenuse. The result is a support base 12 that presents an outward facing and downward angled attachment face 36.

As shown in FIGS. 2 and 3, cleaning surface 14, in a preferred embodiment washable bristle brush 28, is attached to attachment face 36 such that washable bristle brush 28 extends perpendicularly from the surface of attachment face 36.

Resiliently attachable tool cleaner 10 may be attached to a user's arm, leg, and/or golf bag (Not shown). The likely use of resiliently attachable tool cleaner 10 by means of the preferred embodiment illustrated in FIG. 3 is when it is difficult, if not impossible, to pass closed resilient, expandable and contractable, attachment 16 around an object such as a golf bag, so that the use of first elastic compression strap 24 and second elastic compression strap 26 is required. Applicant's resiliently attachable tool cleaner 10 is a "universal" apparatus. That is to say, no matter the size of the user's shoe 22, arm, leg, or golf bag, any object can be accommodated by means of the present invention.

In use, resiliently attachable tool cleaner 10 is utilized by expanding resilient, expandable and contractable, attachment 16 so as to slip resilient, expandable and contractable, attachment 16 over golf shoe 22. As illustrated in FIG. 1, once attached, because attachment 16 is resilient, tool cleaner 10 remains in place by the gripping force of attachment 16. After each swing of a club, the club face can be brought, brushed, swept, across cleaning surface 14, washable bristle brush 28, and cleaned in one motion. This eliminates the need for use of towels, hand held scrub brushes and the like. The simplicity of attaching and removing the tool cleaner to an object enables the tool cleaner 10 of the present invention to be utilized not only at the driving range, but during a regular round of golf as well. That is to say, a golfer could, while waiting for players ahead of them to play, simply attach resiliently attachable tool cleaner 10 to his golf shoe 22, take practice swings and clean the club quickly and efficiently while waiting. For that matter, the golfer could leave resiliently attachable tool cleaner 10 on throughout the round if so desired. Otherwise, the tool cleaner is easily and quickly removable so that, once play resumes, the user can quickly remove it and commence regular play.

While a preferred embodiment of the invention is used with golf clubs, it should be restated that the resiliently attachable tool cleaner 10 of the present invention is not limited to golf tools alone. Again, there are many situations wherein the provision of a removably attachable cleaning surface near at hand so as to free a user's hands and to speed the cleaning of the tool being used quickly and efficiently would be beneficial. Painters, sculptors, contractors, and any individual utilizing tools that require periodic cleaning between uses, such as dentists, and the like would benefit from Applicant's invention.

While the present invention has been disclosed in connection with the preferred embodiment thereof, it should be understood that there may be other embodiments which fall within the spirit and scope of the invention as defined by the following claims.

What is claimed is:

1. A tool cleaning apparatus comprising:

a) a substantially triangular support base including a substantially planar connection side, a substantially planar top side extending from an upper edge of the connection side and a substantially planar attachment face extending from a top edge of the top side to a lower edge of the connection side, the attachment face defining an acute angle with respect to the connection side;

b) a cleaning brush attached to and extending from the attachment face of the support base for cleaning said tool; and c) a resilient, expandable, and contractable, attachment means connected to the connection side of the support base for securing the support base in a desired location.

2. The apparatus of claim 1 wherein said cleaning brush further comprises brush bristles.

3. The apparatus of claim 2 wherein said brush bristles extend perpendicularly from said support base.

4. The apparatus of claim 1 wherein said cleaning brush is removably attachable to said support base.

5. The apparatus of claim 1 wherein said resilient, expandable and contractable, attachment means further comprises an expandable and contractable, elastic compression strap.

6. The apparatus of claim 5 wherein said expandable and contractable, elastic compression strap further comprises a first elastic compression strap section removably attachable to a second elastic compression strap section.

7. The apparatus of claim 6 wherein said first elastic compression strap section and said second elastic compression strap section include hook and loop material for removable attachment.

8. A resilient, removably attachable golf club cleaning apparatus comprising:

a) a substantially triangular support base including a substantially planar connection side, a substantially planar top side extending from an upper edge of the connection side and a substantially planar attachment face extending from a top edge of the top side of the connection side, the attachment face defining an acute angle with respect to the connection side;

b) a cleaning brush, with brush bristles, attached to and extending perpendicularly from the attachment face of the support base for cleaning a golf club; and c) a resilient, expandable and contractable, elastic compression strap connected to the connection side of the support base for securing the support base in a desired location.

9. The apparat of claim 8 wherein said resilient, expandable and contractable, elastic compression strap further comprises a first elastic compression strap section removably attachable to a second elastic compression strap section.

10. The apparatus of claim 9 wherein said first elastic compression strap section and said second elastic compression strap section include hook and loop material for removable attachment.

* * * * *

UNITED STATES PATENT AND TRADEMARK OFFICE

CERTIFICATE OF CORRECTION

PATENT NO. : 6,393,648 B1
DATED : May 28, 2002
INVENTOR(S) : Mark D. Ryenolds

It is certified that error appears in the above-identified patent and that said Letters Patent is hereby corrected as shown below:

Column 1,
Line 52, change “As A” to -- A --.

Column 6,
Line 8, change “apparat” to -- apparatus --.

Signed and Sealed this

Sixteenth Day of July, 2002

*Attest:*

*Attesting Officer*

JAMES E. ROGAN
*Director of the United States Patent and Trademark Office*